United States Patent [19]

Kambara et al.

[11] Patent Number: 5,029,536

[45] Date of Patent: Jul. 9, 1991

[54] AUTOMATIC CLOTH FEEDING DEVICE IN A CYCLE SEWING MACHINE

[75] Inventors: Tetsuo Kambara; Hideyuki Kobayashi, both of Tochigi, Japan

[73] Assignee: SSMC Inc., Edison, N.J.

[21] Appl. No.: 355,931

[22] Filed: May 22, 1989

[30] Foreign Application Priority Data

Jun. 21, 1988 [JP] Japan ..... 81860[U]

[51] Int. Cl.[5] ..... D05B 3/06

[52] U.S. Cl. ..... 112/73; 112/76; 112/311

[58] Field of Search ..... 112/70, 76, 65, 67, 112/113, 114, 303, 311, 73, 66

[56] References Cited

U.S. PATENT DOCUMENTS 3,332,377 7/1967 Emslie et al. ..... 112/76 X 4,173,191 11/1979 Taddicken ..... 112/65

4,590,870 5/1986 Kawaguchi et al. ..... 112/70

*Primary Examiner*—Peter Nerbun

*Attorney, Agent, or Firm*—Theodore Jay

[57] ABSTRACT

An automatic cloth feeding device in a cycle sewing machine is provided with first and a second cloth pressers which are placed on a working table and respectively hold and release both ends of the cloth in the lateral direction. Rotary motion of a first rotary shaft is changed to a linear motion by a first converting mechanism to cause the first cloth presser to move laterally while rotary motion of a second rotary shaft is changed to a linear motion by a second converting mechanism to cause the second cloth presser to move laterally. The first rotary shaft and the second rotary shaft are connected with or disconnected from each other by a clutch so that the first rotary shaft is driven by or released from a drive unit.

3 Claims, 6 Drawing Sheets

20

AUTOMATIC CLOTH FEEDING DEVICE IN A CYCLE SEWING MACHINE

BACKGROUND OF THE INVENTION

1. Field of the Invention

The present invention relates to an automatic cloth feeding device in a cycle sewing machine capable of automatically buttonholing the sewn material.

2. Prior Art

The prior art automatic cloth feeding device in a cycle sewing machine of this type is disclosed, for example, in Japanese Patent Publication No. 63-5113 which comprises a pair of cloth pressers for moving successively the material to the position where the material is sewn, a first drive means for moving both the pair of cloth pressers, and a second drive means for changing the interval between the both cloth pressers by moving at least one of the pair of cloth pressers. With such an arrangement, both the cloth pressers are moved together by driving of the first drive unit while one of the cloth pressers is moved by driving of the second drive unit whereby the interval between both the cloth pressers are automatically changed.

However, the prior art automatic cloth feeding device in a cycle sewing machine utilizes at least two drive units, namely, first and second drive units are required for moving the one pair of cloth pressers whereby the construction of the cycling machine is complex and the space required for housing the drive units prevents the cycle machine from being reduced in size.

SUMMARY OF THE INVENTION

It is an object of the present invention to provide an automatic cloth feeding device in a cycle sewing machine having a pair of cloth pressers driven by a single drive unit with simple structure and precise operation.

To achieve the above object, the automatic cloth feeding device in a cycle sewing machine employs a working table on which a sewn material is placed. A cycle sewing machine is mounted on substantially the central portion of the working table, this machine having a needle swingable in zigzag and a cloth presser metal which cooperates with each other to buttonhole a predetermined portion of the sewn material on the working table every sewing operation. A pair of first and a second cloth pressers are provided at both sides of the needle for holding and releasing the both ends of the laterally extending sewn material. A transfer means is used to drive the pair of cloth pressers laterally along an upper surface of the working table, this transfer means being a first rotary shaft disposed under the working table and extending laterally. A first converting means is employed for converting the rotary motion of the first rotary shaft into a linear motion of the first cloth presser. A second rotary shaft is disposed coaxially with the first rotary shaft. A clutch is provided for connecting the first rotary shaft with the second rotary shaft or disconnecting the first rotary shaft from the second rotary shaft.

The above and other objects, features and advantages of the present invention will become more apparent from the following description taken into conjunction with the accompanying drawings.

DESCRIPTION OF PREFERRED EMBODIMENT OF THE INVENTION

Figure 1:
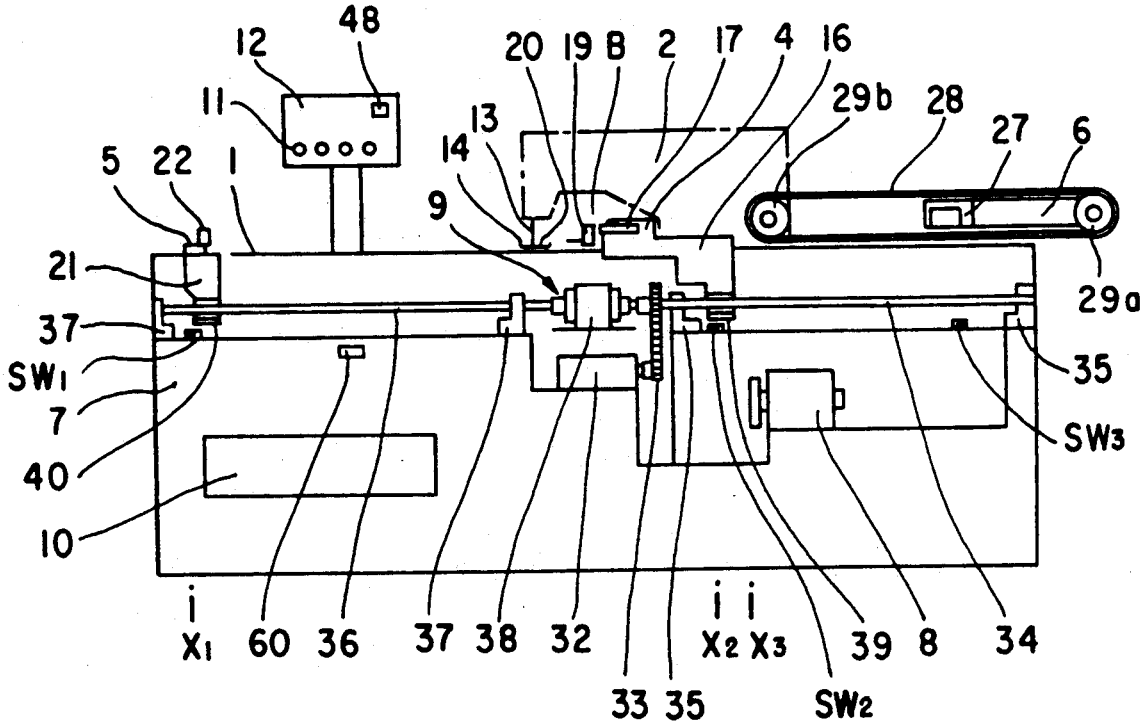
FIG. 1 is a front view of an automatic cloth feeding device in a cycle sewing machine according to a preferred embodiment of the present invention.
Figure 2:
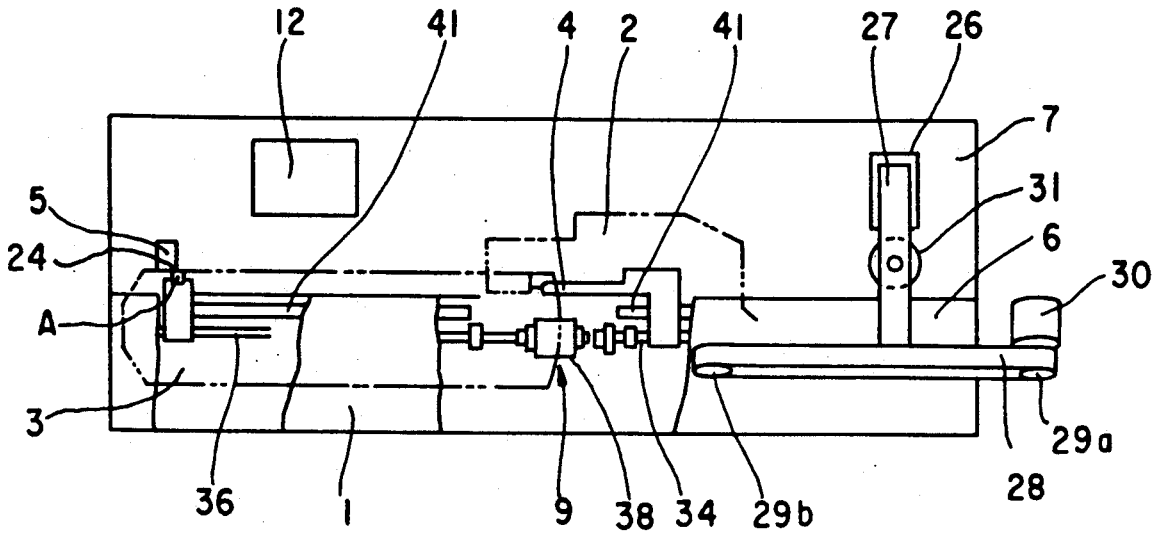
FIG. 2 is a plan view of FIG. 1.

An automatic cloth feeding device in a cycle sewing machine comprises a working table 1 on which a sewn material 3 is placed. A cycle sewing machine 2 is mounted on substantially the central portion of the working table 1. The cycle sewing machine has a needle 13 swingable in zigzag and a cloth presser metal 14 which cooperate with each other to buttonhole a predetermined portion of the sewn material 3 on the working table 1 every sewing operation. A pair of first and a second cloth pressers 4, 5 are disposed at both sides of the needle 13 for holding and releasing the both ends of the laterally extending sewn material 3 and for conveying the both ends of the sewn material 3 in the lateral direction to a predetermined position of the sewing portion. A carriage 6 is mounted at the right end upper surface of the working table 1 for conveying and discharging the processed sewn material 3. A sewing machine table 7 supports the working table 1 and a motor 8 for driving the cycle sewing machine 2. A transfer means 9 is used for transferring the pair of cloth pressers 4, 5, alone or together with the sewn material 3. A control unit 10 sequentially controls the transfer means 9 and other constituents. An operation box is disposed over the working table 1 and has a setting button 11 for operating the control unit 10 and an initial setting operation switch 48. A switch 60 mounted on the sewing machine table 7 is used for turning on or off the sewing machine.

The first presser 4 is arranged at the right side of the needle drop point 20 of the cycle sewing machine 2 in FIG. 1 and is supported by a securing member 16. A clamper B is swingable about a fulcrum 19 of the securing member 16 by a reciprocal movement of the piston rod of a cylinder 17 for holding or releasing the one end of the sewn material 3.

The second cloth presser 5 is arranged at the left side of the needle drop 20 of the cycle sewing machine 2 in FIG. 1 and is supported by a securing member 21. A clamper A is swingable about a fulcrum 24 of the fixing member 21 by a reciprocal movement of the piston rod of a cylinder 22 for holding or releasing the other end of the sewn material 3.

The securing members 16, 21 can move laterally on a guide 41 fixed to the sewing machine table 7 along an upper surface of the working table 1 by actuation of the transfer means 9 for thereby moving the first and the second cloth pressers 4, 5, integrated with the fixing members 16, 21, laterally. That is, provided under the working table 1 are a first rotary shaft 34 extending laterally and disposed at the right side of the working table 1 and a second rotary shaft 36 arranged coaxially with the first rotary shaft 34 and disposed at the left side of the first rotary shaft 34. Both the first and the second rotary shafts 34, 36 are respectively rotatably supported by a pair of brackets 35, 35; 37, 37. The rotary shaft 34 is rotatably driven by a servomotor 32 secured to the sewing machine table 7 via a timing belt 33. An electromagnetic clutch brake 38 as a clutch means is interposed between the first and the second rotary shafts 34, 36 for connecting the first rotary shaft 34 to the second rotary shaft 36; for rotating both the shafts 34, 36 together or disconnecting the first rotary shaft 34 from the second rotary shaft 36; and for rotating the shaft 36 only respectively actuated on the reception of electric signals from the control unit 10.

The first rotary shaft 34 has a first converting mechanism 39 provided thereto for converting the rotary motion of the rotary shaft 34 to a linear motion of the securing member 16 for thereby allowing the first cloth presser 4 to move on the guide 41 reciprocally linearly depending on the direction of the rotary motion of the first rotary shaft 34. The second rotary shaft 36 has a second converting mechanism 40 provided thereto for converting the rotary motion of the rotary shaft 36 to a linear motion of the fixing member 21 for thereby allowing the second cloth presser 5 to move on the guide 41 reciprocally linearly depending on the direction of the rotary motion of the second rotary shaft 36. The first and the second converting mechanisms 39, 40 may be a screw shaft having the same pitch screwed in the same direction to which a nut is screwed, for example, a ballbushing.

The carriage 6 comprises a bracket 26 fixed to a right end rear portion of the working table 1. An arm 27 is supported by the bracket 26. A drive pulley 29*a* and a driven pulley 29*b* are respectively rotatably supported by the arm 27. A transfer belt 28 is entrained around the both pulleys 29*a*, 29*b*. A carriage motor 30 drives the drive pulley 29*a*, and a cylinder 31 fixed to the working sewing machine table 7 and actuated by an air under pressure. The carriage motor 30 and the cylinder 31 are respectively driven on the reception of the electric signals from the control unit 10 in a predetermined relation with each other to thereby discharge the sewn material on the working table 1 by the transfer belt 28.

The sewing machine table 7 has inside thereof limit switches SW1, SW2 for respectively setting the limits of the movements of the second and the first cloth pressers 5, 4 from original positions X1, X2 and a limit switch SW3 for setting the limit of movement of first cloth presser 4 to move from a reference position X3.

The limit switch SW1 is engaged with or disengaged from a part of the securing member 21 to be turned on or off to thereby disconnect from the clutch brake 38 on the basis of the ON signal issued at the time of turning on of the limit switch SW1. The limit switches SW2 and SW3 are engaged with or disengaged from a part of the fixing member 16 to be turned on or off to thereby actuate the clutch brake 38 or the servomotor 32 on the reception of the ON switched sued at the time of turning on of the limit switches SW2 and SW3. According to the embodiment, the interval between the both limit switches SW2 and SW3 is set longer than an effective length of the second rotary shaft 36 disposed at the right side of the limit switch SW1.

Figure 3:
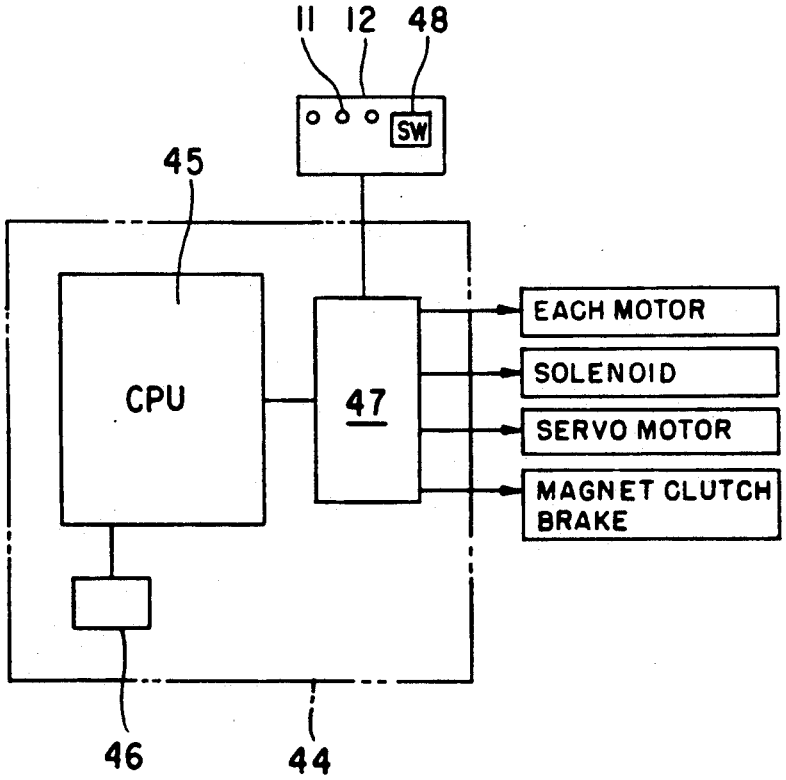
FIG. 3 is a block diagram of the constituents of the automatic cloth feeding device in a cycle sewing machine of FIG. 1.

The control unit 10 comprises a microcomputer 44 as illustrated in FIG. 3. The microcomputer 44 comprises a central processing unit (CPU) 45, a memory 46 made of a read only memory (ROM) and a random access memory (RAM), and input/output signal processing circuit 47, etc. The ROM of the memory 46 stores previously therein operation information such as holding and releasing operations by the first and the second cloth pressers 4, 5; operation of the transfer means 9; operation of the clutch brake 38; operation of the cycle sewing machine 2; operation of the carriage 6; and the distance L1 from the original positions X1, X2 from which the first and the second cloth pressers 4, 5 move to an initial position. The RAM of the memory 46 stores therein information such as a number of button holes, pitch D of the button hole, and a distance A from the end of the sewn material 3 to a first button hole. The operation box 12 has a push button 11 for inputting the information such as the number of button holes, the pitch D of the button hole, and the distance A from the end of the sewn material 3 to a first button hole into the RAM. A plurality of light emitted diodes (LEDS) digitally display the inputted numeric data.

A buttonholing operation with use of the automatic cloth feeding device in a cycle sewing machine according to the present invention will be described with reference to FIGS. 4 to 7.

Figure 4:
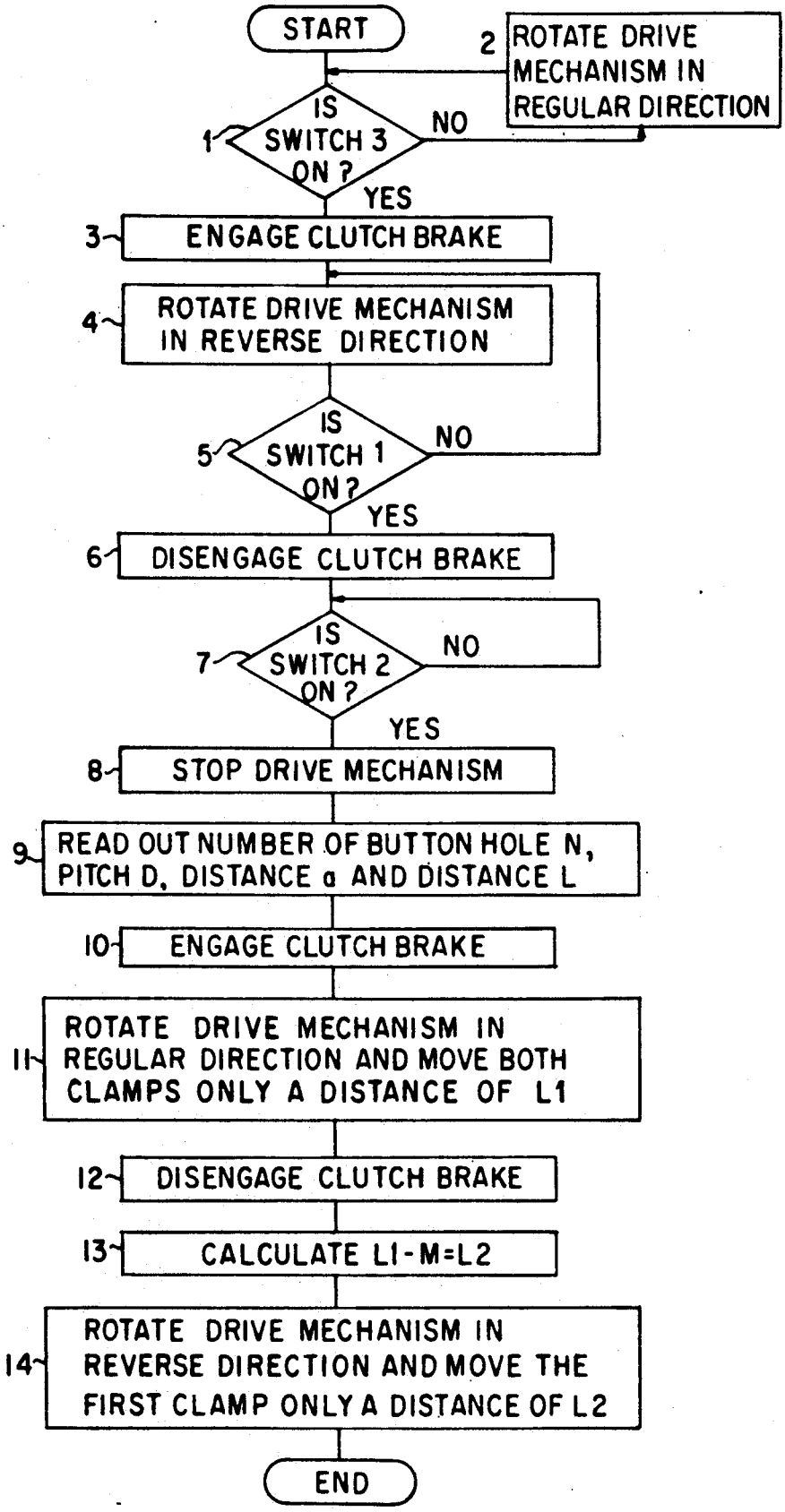
FIGS. 4 and 5 are flow charts of the operations of the automatic cloth feeding device in a cycle sewing machine of FIG. 1.
Figure 6:
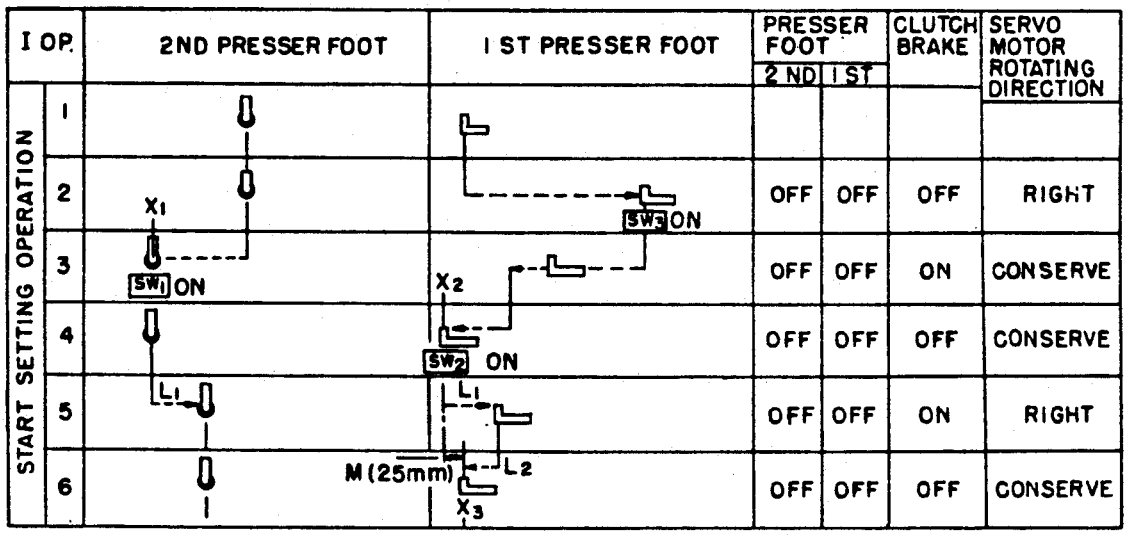
FIG. 6 is a chart of the initial setting steps of operations of the automatic cloth feeding device in a cycle sewing machine of FIG. 1.

First, an initial setting step just before holding the sewn material 3 by the first and the second cloth pressers 4, 5 will be described with reference to the flow charts illustrated in FIG. 4 and an initial setting step chart as illustrated in FIG. 6.

An operation switch 48 is turned on to decide whether or not the limit switch SW3 is turned on in Step 1. When the limit switch SW3 is turned off, the servomotor (drive unit) 32 is normally driven in Step 2 to move only the first cloth presser 4. If the limit switch SW3 is engaged with the securing member 16 of the first cloth presser 4 to be turned on (equivalent to second step in FIG. 6), the operation proceeds to Step 3 for actuating the clutch brake 38 for connecting the first and the second rotary shafts 34, 36 and simultaneously reverse driving the servomotor 32 in Step 4 to thereby transfer both the first and the second cloth pressers 4, 5 to the left (equivalent to third step in FIG. 6). If the limit switch SW1 is engaged with the securing member 21 of the second cloth presser 5 to be turned on, the operation proceeds to Step 6 to activate the clutch 38 for disconnecting the first rotary shaft 34 from the second rotary shaft 36 thereby allowing the servomotor 32 to be reverse driven until the limit switch SW2 is engaged with the securing member 16 of the first cloth presser 4 in Step 7 (equivalent to fourth step in FIG. 6). If the limit switch SW2 is turned on, the servomotor 32 is stopped at Step 8, and at Step 9, on the basis of the operation of the push button 11 of the operation box 12, the information of the number N of the button holes, the pitch D of the button hole, the distance A from the end of the sewn material 3 to the first button hole respectively stored in the RAM of the memory 46 is read out. The distance L1 from the original positions X1, X2 of the first and the second cloth pressers 4, 5 to the initial position stored which is determined depending on the sewn material 3 in the ROM of the memory 46 is read out by looking up the data table corresponding to the program mode stored in the ROM. The distance L1 is the numeric data to be determined depending on the designs and the sizes of the sewn material and set in the manner that the second cloth presser 5 does not interfere with the needle 13, and the cloth presser metal 14 of the cycle sewing machine 2 at the time of sewing the last button 51 on the sewn material 3.

Next, in Step 10, the clutch brake 38 is clutched to connect the first and the second rotary shafts 34, 35 to thereby normally drive the servomotor 32 in Step 11 to move the first and the second cloth pressers 4, 5 to the rightward for the distance L1 (equivalent to fifth step in FIG. 6). The operation further proceeds to Step 12 where the clutch brake 38 is not clutched to disengage the first rotary shaft 34 from the second rotary shaft 36 and in Step 13 an arithmetic operation for L2=L1−M is effected. In Step 14, the servomotor 32 is reverse driven to move the first cloth presser 4 leftward in the distance L2 for allowing the first cloth presser 4 to move rightward to the reference position X3 remoted from the original position X2 for the length M of the button hole (about 25 mm) (equivalent to sixth step in FIG. 6). The distance M (about 25 mm) will be described in detail hereinafter. With the above operations, the initial setting operation is completed.

Figure 5:
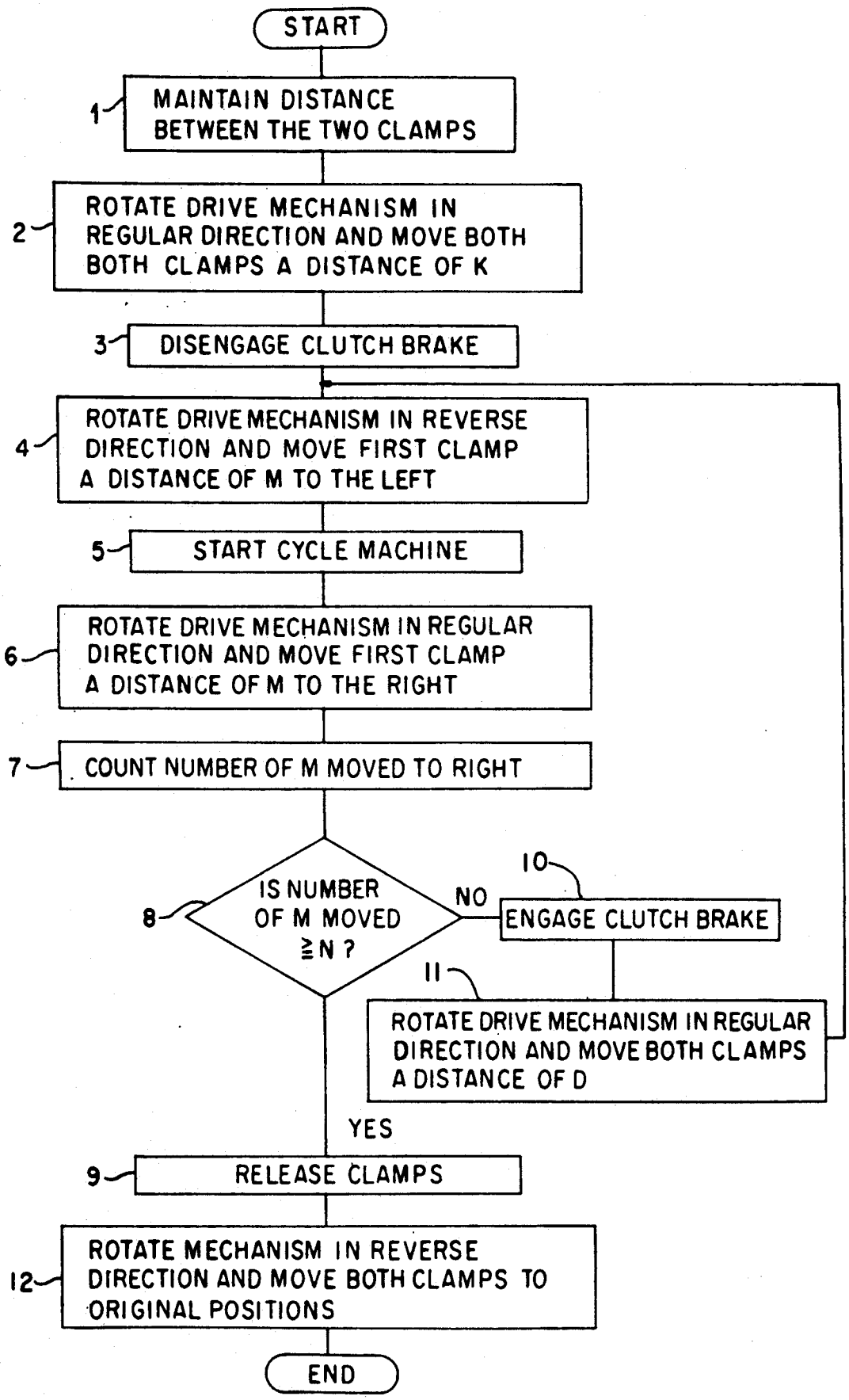

A sewing operation of an automatic cloth feeding device in a cycle sewing machine according to the present invention will be described with reference to the flow chart as illustrated in FIG. 5 and the chart in FIG. 7.

Firstly, the sewn material 3 before subjecting to the buttonholing is placed on the working table 1 by a means (not shown) after the initial setting operation is completed. In Step 1, the operator turns on the push button 11 whereby the first and the second cloth presser 4, 5 hold the both ends of the sewn material 3 (equivalent to 01 step of in FIG. 7). At this state, the servomotor 32 is normally driven to move the first and the second cloth pressers 4, 5 rightward for the interval K for according the rear end position of the first button hole 49 of the sewn material with the needle drop point 20 of the cycle sewing machine in Step 2 (equivalent to 02 step in FIG. 7). The moving distance K is determined relative to a position where the sewn material 3 is placed on the working table 1 and determined normally by a numerical data stored previously in the ROM of the memory 46.

Figure 7:
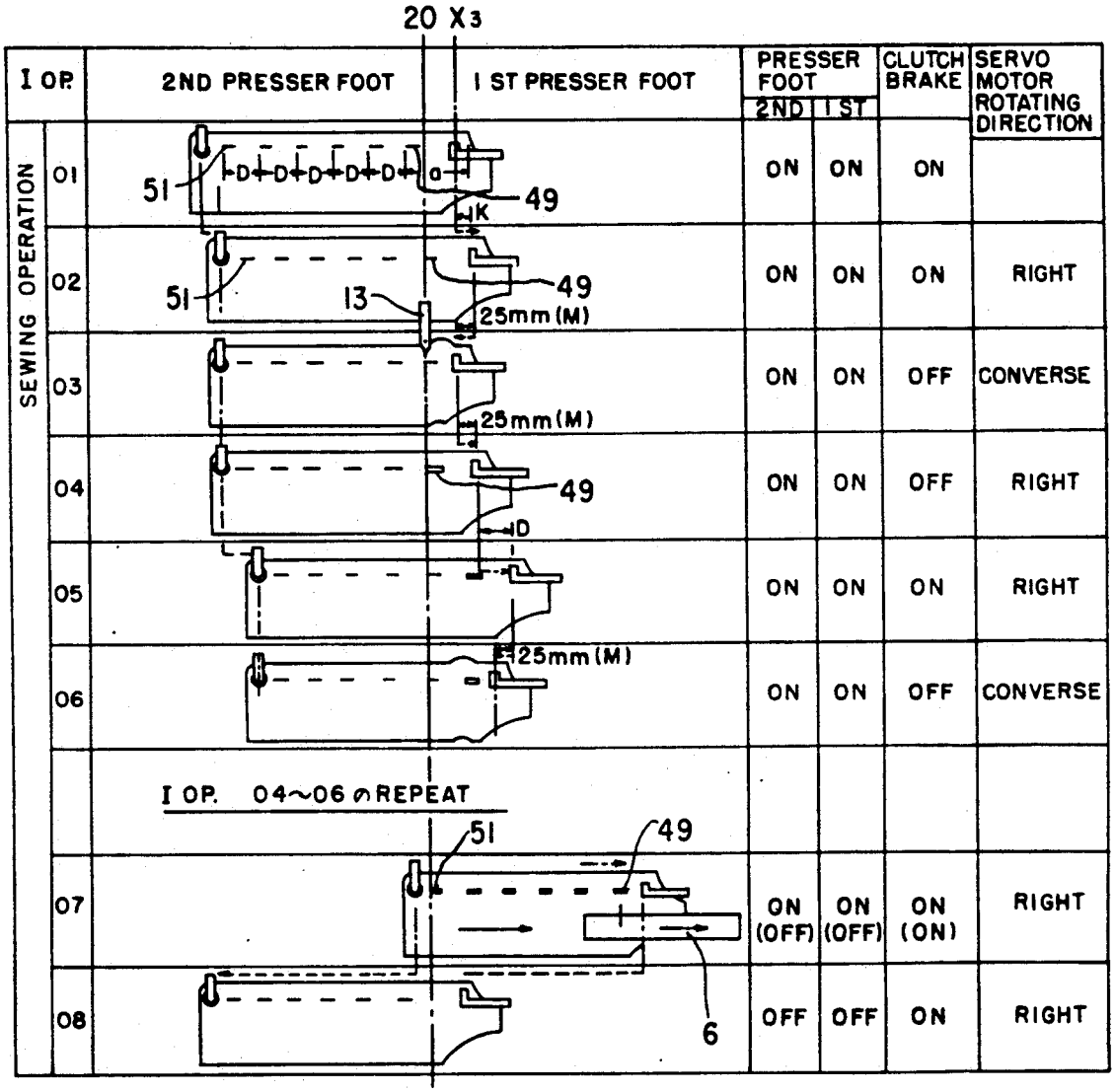
FIG. 7 is another chart of the steps of operations of the automatic cloth feeding device in a cycle sewing machine of FIG. 1.

In Step 3, the clutch brake 38 is not clutched to disconnect the first rotary shaft 34 from the second rotary shaft 36 to reversely drive the servomotor 32 for thereby allowing the one end of the sewn material 3 to move leftward for the button hole length M (about 25 mm) for slacking the sewn material 3 (equivalent to 03 step in FIG. 7).

The prior art cycle sewing machine shown in phantom at 2 is provided with a cloth feeding machanism in which the sewing machine 2 can feed the sewn material 3 for the distance equivalent to the length of the button hole in the case where the buttonholing operation is effected for the predetermined length M. For this reason, it is necessary to slacken the sewn material held by the first and the second cloth pressers 4, 5 for the length equivalent to the length M of the button hole.

According to the present invention, the clutch brake is not clutched to disconnect the first rotary shaft 34 from the second rotary shaft 36 for reverse driving the servomotor 32 to slacken the sewn material 3. The reason for providing the interval equivalent to the length M of the button hole (about 25 mm) between the original position X2 in Step 7 at the initial setting time (equivalent to fourth step in FIG. 6) and the reference X3 in Step 14 (equivalent to sixth step in FIG. 6) is that the first cloth presser 4 does not exceed the original position X2 at the time of moving leftward for the length M (about 25 mm) in Step 4.

In step 5, the cycle sewing machine 2 is driven to sew the first button hole 49 and normally drives the servomotor 32 in Step 6 to move the first cloth presser 4 rightward for the length M (about 25 mm) to eliminate the slacking of the sewn material 3 (equivalent to 04 step in FIG. 7). In Step 7, the number of rightward movement M in Step 6 is counted to decide that the rightward movement M reaches N (number of the button hole) or not in Step 8. If the movement does not reach N, the clutch brake 38 is clutched in Step 10 for connecting the first rotary shaft 34 with the second rotary shaft 36 for driving normally the servomotor 32 in Step 11 whereby the first and the second cloth pressers 4, 5 are moved rightward for the button hole interval D. Thereafter, the steps 4 to 8 are repeated to reach the number N, namely when the sewing of the last button hole 51 is completed, the holding operation of the first and the second cloth pressers 4, 5 are released by the cylinders 17, 22 in Step 9 to reversely rotate the servomotor 32 in Step 12 to return the first and the second cloth pressers 4, 5 leftward until it reaches the initial position in Step 1 (equivalent to 08 step in FIG. 7). At this time, the next material to be sewn is placed on the working table 1 under the both cloth pressers 4, 5 for preparation of sewing operation. The sewn material after subjected to the sewing operation is discharged from the working table 1 by switching the motor 30 of the carriage 6 and magnet valve to actuate the cylinder 31.

It is not required to provide a step for slacking the sewn material 3 in Step 4 for the length corresponding to the length M of the button hole in the button sewing indexor so that the step for returning the first presser 4 in Step 6 to its original position is not required.

The servomotor 32 as the drive unit rotates the first rotary shaft 4 but the servomotor 32 can also rotate the second rotary shaft 5 which result in obtaining the same effect as set forth above.

With the arrangement of the automatic cloth feeding device in a cycle sewing machine in the present invention, the following advantages are obtained.

Inasmuch as the pair of cloth pressers for holding the both ends of the sewn material is driven by a single drive unit, the pair of pressers are precisely movable in synchronism with each other upon clutching of the clutch while one of the cloth pressers can be moved to change the interval between the pair of cloth pressers without clutching the clutch with a simple construction with safety, the switching of the clutching is effected simply and quickly which cope with the changes of the sizes, etc. of the sewn material for thereby carrying out automatically a plurality of buttonholing operations.

Although the invention has been described in its preferred form with a certain degree of particulariity, it is to be understood that many variations and changes are possible in the invention without departing from the scope thereof.

What is claimed is:

1. In combination with a cycle sewing machine having a needle having opposite sides and swingable in zigzag and a cloth presser metal, an automatic cloth feeding device for sewn material, said device comprising:

a working table on which the sewn material is placed in laterally extended position, the machine being mounted on a substantially central portion of the table, the needle and cloth presser metal of the machine cooperating to buttonhole a predetermined portion of the sewn material on the table every sewing operation;

a pair of first and second cloth pressers, one presser being disposed at one side of the needle, the other presser being disposed at the other side of the needle, the pair of pressers alternately holding and releasing both ends of the laterally extending material; and transfer means for driving the pair of cloth pressers laterally along an upper surface of the working table, the transfer means including a first rotary shaft disposed under the working table and extending laterally, a first converting means for converting the rotary motion of the first rotary shaft into a linear motion of the first cloth presser, a second rotary shaft disposed coaxially with the first rotary shaft, a clutch having a first position at which the first rotary shaft is connected with the second rotary shaft and a second position at which the first rotary shaft is disconnected from the second rotary shaft, and a drive unit for rotatably driving at least one of the first and the second rotary shafts.

2. The combination of claim 1 wherein the drive unit can also drive both shafts.

3. The combination of claim 2 wherein the clutch is an electromagnetic clutch brake interposed between the first and second shafts.

* * * * *